US008459190B2

(12) United States Patent
Erdie

(10) Patent No.: US 8,459,190 B2
(45) Date of Patent: Jun. 11, 2013

(54) TRIANGULAR SHIPPING CONTAINER WITH POLYGONAL INNER SUPPORT

(76) Inventor: Jason S. Erdie, Richfield, OH (US)

( * ) Notice: Subject to any disclaimer, the term of this patent is extended or adjusted under 35 U.S.C. 154(b) by 15 days.

(21) Appl. No.: 13/071,157

(22) Filed: Mar. 24, 2011

(65) Prior Publication Data

US 2011/0168766 A1 Jul. 14, 2011

Related U.S. Application Data

(63) Continuation of application No. PCT/US2010/058559, filed on Dec. 1, 2010.

(60) Provisional application No. 61/266,422, filed on Dec. 3, 2009, provisional application No. 61/373,481, filed on Aug. 13, 2010.

(51) Int. Cl.
*B65D 19/34* (2006.01)

(52) U.S. Cl.
USPC ..... 108/51.3

(58) Field of Classification Search
USPC ..... 108/51.11, 56.3, 51.3; 206/386, 206/595, 597–600; 493/104, 79, 68
See application file for complete search history.

(56) References Cited

U.S. PATENT DOCUMENTS

| | | | |
|---|---|---|---|
| 928,423 | A | 7/1909 | Belson |
| 1,256,031 | A | 2/1918 | Miller |
| 1,327,641 | A | 1/1920 | Stolp |
| 1,397,756 | A | 11/1921 | Drysdale |
| 1,701,059 | A | 2/1929 | Andrews |
| 1,821,741 | A | 9/1931 | Dalton |
| 1,850,329 | A | 3/1932 | Metzger |
| 2,203,513 | A | 6/1940 | Amberg |
| 2,483,464 | A | 10/1949 | Johnson |
| 2,653,708 | A | 9/1953 | Spalding |
| 2,728,545 | A | 12/1955 | Hermitage |
| 2,828,902 | A | 4/1958 | Ringler |
| 3,014,637 | A | 12/1961 | Wilson |
| 3,157,343 | A | 11/1964 | Kendall |
| 3,191,508 | A | 6/1965 | Beamish |
| 3,199,765 | A | 8/1965 | Locke |
| 3,373,663 | A | 3/1968 | Heim |

(Continued)

FOREIGN PATENT DOCUMENTS

| | | | |
|---|---|---|---|
| DE | 18 96 847 | U | 7/1964 |
| DE | 200 15 985 | U1 | 12/2000 |

(Continued)

OTHER PUBLICATIONS

International Search Report/Written Opinion for International Patent Application No. PCT/US2010/058559 dated Feb. 8, 2011.

*Primary Examiner* — Janet M Wilkens
(74) *Attorney, Agent, or Firm* — Rankin, Hill & Clark LLP

(57) ABSTRACT

An elongate structure that includes a hollow outer portion and a hollow inner portion disposed within the hollow outer portion. The hollow outer portion includes a first outer side surface, a second outer side surface, and a third outer side surface that define first, second and third intersecting planes respectively. The three intersecting planes form three dihedral angles whose sum is about 180°. The hollow inner portion is in contact with each inner side of the hollow outer portion. Further, the hollow inner portion includes at least one panel that extends between each inner side of the hollow outer portion to thereby form hollow inner triangular channels.

17 Claims, 13 Drawing Sheets

U.S. PATENT DOCUMENTS

| | | | |
|---|---|---|---|
| 3,434,435 | A | 3/1969 | Achermann et al. |
| 3,482,760 | A | 12/1969 | Pascus et al. |
| 3,552,081 | A | 1/1971 | Leasure |
| 3,760,968 | A | 9/1973 | Amberg et al. |
| 3,880,342 | A | 4/1975 | Longo, Jr. |
| 3,891,136 | A | 6/1975 | Woeste |
| 4,053,346 | A | 10/1977 | Amberg et al. |
| 4,202,485 | A | 5/1980 | Fremion |
| 4,245,771 | A | 1/1981 | Christian |
| 4,246,059 | A | 1/1981 | Hadl |
| 4,253,601 | A | 3/1981 | Kossoff |
| 4,269,348 | A | 5/1981 | Young |
| 4,281,788 | A | 8/1981 | Aeba |
| 4,339,067 | A | 7/1982 | Bessey |
| 4,488,659 | A | 12/1984 | Jones |
| 4,563,377 | A | 1/1986 | Melli |
| 4,880,944 | A | 11/1989 | Kanaljuk et al. |
| 4,935,091 | A | 6/1990 | Cress et al. |
| 4,968,369 | A | 11/1990 | Darcy |
| 5,005,705 | A | 4/1991 | Combs |
| 5,040,696 | A | 8/1991 | Liebel |
| 5,042,657 | A | 8/1991 | Dunn |
| 5,078,272 | A | 1/1992 | Combs |
| 5,339,746 | A | 8/1994 | Vannatta |
| 5,417,341 | A | 5/1995 | Petriekis et al. |
| 5,423,270 | A | 6/1995 | Kilpatrick et al. |
| 5,425,499 | A | 6/1995 | Pfieffer |
| 5,503,085 | A | 4/1996 | Rozek |
| 5,503,325 | A | 4/1996 | Nelson et al. |
| 5,640,835 | A | 6/1997 | Muscoplat |
| 5,660,119 | A | 8/1997 | Perkins |
| 5,699,959 | A | 12/1997 | Huspeka et al. |
| 5,738,218 | A | 4/1998 | Gonzales |
| 5,797,832 | A | 8/1998 | Ong et al. |
| 5,813,965 | A | 9/1998 | Mitchell et al. |
| 5,836,254 | A | 11/1998 | Johansson |
| 5,873,514 | A | 2/1999 | Brooks |
| 6,045,085 | A | 4/2000 | Anderson et al. |
| 6,102,568 | A | 8/2000 | Davis |
| 6,123,254 | A | 9/2000 | Dupuis |
| 6,397,653 | B1 | 6/2002 | Kane et al. |
| 6,446,859 | B1 | 9/2002 | Holladay |
| 6,539,880 | B2 | 4/2003 | Simms |
| 6,926,196 | B2 | 8/2005 | Testerman et al. |
| 7,219,830 | B2 | 5/2007 | West |
| 7,296,729 | B2 | 11/2007 | Erdie |
| 7,328,833 | B1 | 2/2008 | Wiley |
| 7,334,686 | B2 | 2/2008 | Filardi |
| 7,347,326 | B2 | 3/2008 | Baechle |
| 7,581,670 | B2 | 9/2009 | Erdie |
| 7,581,671 | B2 | 9/2009 | Erdie |
| 7,699,211 | B2 | 4/2010 | Holloway |
| 2002/0088378 | A1 | 7/2002 | Simms |
| 2002/0190110 | A1 | 12/2002 | Polloni et al. |
| 2005/0000840 | A1 | 1/2005 | Cahill |
| 2005/0199696 | A1 | 9/2005 | MacConkey et al. |
| 2006/0175333 | A1 | 8/2006 | Johanson et al. |
| 2007/0228119 | A1 | 10/2007 | Barner et al. |
| 2007/0240547 | A1 | 10/2007 | Dick et al. |
| 2008/0078819 | A1 | 4/2008 | Strong et al. |
| 2008/0087383 | A1 | 4/2008 | Biktjorn et al. |
| 2008/0128478 | A1 | 6/2008 | Quadrelli |
| 2009/0308289 | A1 | 12/2009 | Ferguson |
| 2010/0219232 | A1 | 9/2010 | Smith |

FOREIGN PATENT DOCUMENTS

| | | | |
|---|---|---|---|
| DE | 695 22 575 T2 | | 7/2002 |
| DE | 697 24 634 T2 | | 6/2004 |
| FR | 2861699 | * | 5/2005 |
| WO | 95/25672 | | 9/1995 |
| ZA | 199504390 | | 5/1995 |

* cited by examiner

TRIANGULAR SHIPPING CONTAINER WITH POLYGONAL INNER SUPPORT

CROSS-REFERENCE TO RELATED APPLICATIONS

This application is a continuation of co-pending Application Ser. No. PCT/US2010/058559, filed Dec. 1, 2010, through which priority is claimed to U.S. Provisional Application Ser. Nos. 61/266,422, filed Dec. 3, 2009, and 61/373,481, filed Aug. 13, 2010.

FIELD OF THE INVENTION

The present invention relates to shipping containers and, more particularly, to a shipping container having a generally triangular shaped outer portion and a polygonal shaped inner portion.

BACKGROUND

Triangular shipping containers are known. Most triangular shipping containers are formed by folding a pre-cut sheet of corrugated cardboard along pre-defined fold lines and tucking tabs into pre-cut slots. The ends of known triangular shipping containers are typically closed off by folded flaps of the corrugated material. Such known containers advantageously take up little space in an unfolded condition. Furthermore, when in an assembled state, the containers do not roll off conveyor belts, which can be a problem with shipping containers formed of paper tubes having a circular cross-section.

Unfortunately known triangular shipping containers can be somewhat difficult and time-consuming to fold. Folding mistakes are made with some frequency, which causes the triangular shipping container to fail during shipment. Shippers often address this problem by applying large amounts of shipping tape to secure the containers. In addition, known triangular shipping containers tend not to exhibit significant beam strength, and will fail when a force is applied perpendicularly to the longitudinal axis.

SUMMARY

In view of the foregoing, the present invention is directed toward an elongate structure that can, in some embodiments, be used as a shipping container. The elongate structure according to the invention includes a hollow outer portion formed of sheet material and a hollow inner portion formed of sheet material, which is disposed within the hollow outer portion. The hollow outer portion includes at least a first outer side surface that defines a first plane, a second outer side surface that defines a second plane, and a third outer side surface that defines a third plane. The first plane intersects with the second plane at a first dihedral angle, the second plane intersects with the third plane at a second dihedral angle, and third plane intersects with the first plane at a third dihedral angle. The sum of the first dihedral angle, the second dihedral angle and the third dihedral angle is about 180°, giving the outer portion a generally triangular shape. The hollow inner portion contacts a first inner side of the hollow outer portion opposite the first outer side surface, a second inner side of the hollow outer portion opposite the second outer side surface, and a third inner side of the hollow outer portion opposite the third outer side surface. The hollow inner portion includes at least a first panel that extends between the first inner side of the hollow outer portion and the second inner side of the hollow outer portion so as to define a first hollow inner triangular channel, and a second panel that extends between the second inner side of the hollow outer portion and the third inner side of the hollow outer portion so as to define a second hollow inner triangular channel. Matter can be placed within the hollow inner portion of the elongate structure, and the ends thereof can be sealed to create a shipping container that does not roll off conveyor belts and which exhibits superior beam strength.

The foregoing and other features of the invention are hereinafter more fully described and particularly pointed out in the claims, the following description setting forth in detail certain illustrative embodiments of the invention, these being indicative, however, of but a few of the various ways in which the principles of the present invention may be employed.

DETAILED DESCRIPTION

Figure 1:
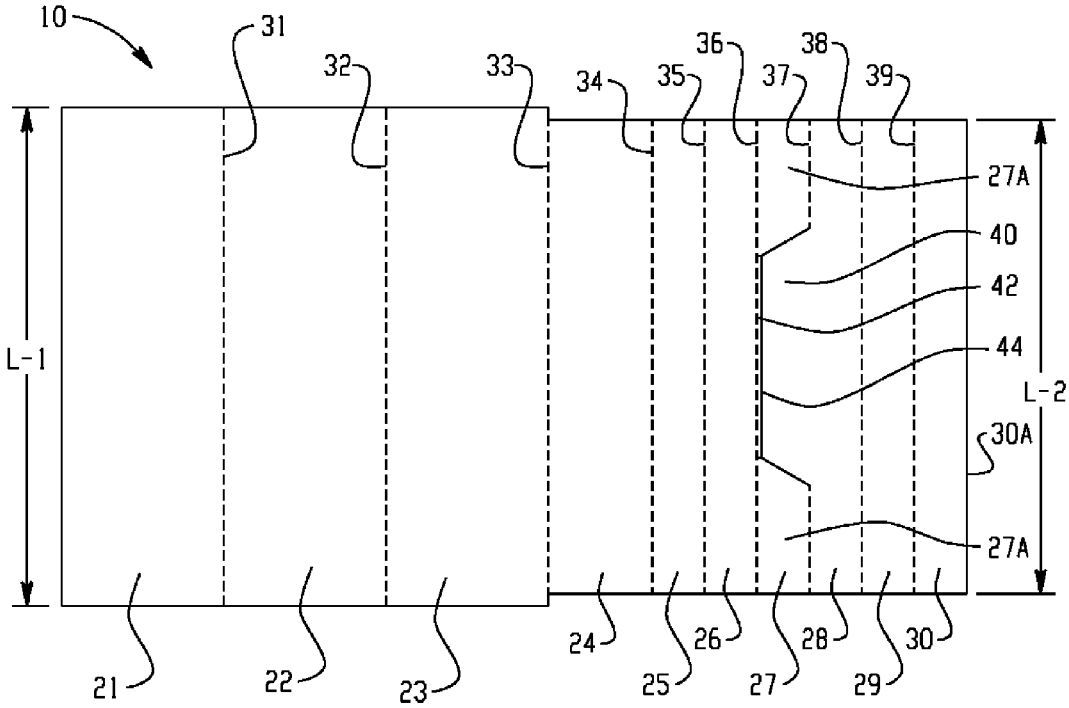
FIG. 1 shows a top view of a completely unassembled elongate structure in accordance with a first embodiment of the invention.

Referring now to the drawings, FIGS. 1-4 show a first embodiment of an elongate structure 10 according to the invention. In the embodiment shown in FIGS. 1-4, when fully assembled, the elongate structure 10 includes a hollow outer portion 12 comprised of a generally triangular tubular structure and a hollow inner portion 14 comprised of a generally hexagonal tubular structure. The hollow outer portion 12 and the hollow inner portion 14 are formed from multiple panels, as will be subsequently described. Further, the elongate structure 10 is adapted to be cut from a single sheet of corrugated cardboard or other type of sheet material.

FIG. 1 shows the elongate structure 10 in a completely unassembled state. The elongate structure 10 includes a first panel 21, a second panel 22, a third panel 23, a fourth panel 24, a fifth panel 25, a sixth panel 26, a seventh panel 27, an eighth panel 28, a ninth panel 29, and a tenth panel 30. The first panel 21 is joined to the second panel 22 at a first fold-line 31. The second panel 22 is joined to the third panel 23 at a second fold-line 32. The third panel 23 is joined to the fourth panel 24 at a third fold line 33. The fourth panel 24 is joined to the fifth panel 25 at a fourth fold line 34. The fifth panel 25 is joined to the sixth panel 26 at a fifth fold line 35. The sixth panel 26 is joined to the seventh panel 27 at a sixth fold line 36. The seventh panel 27 is joined to the eighth panel 28 at a seventh fold line 37. The eighth panel 28 is joined to the ninth panel 29 at an eighth fold line 38. And, the ninth panel 29 is joined to the tenth panel 30 at a ninth fold line 39. Each fold line 31-39 is generally parallel to a longitudinal axis of the elongate structure 10 when fully assembled.

In the embodiment shown in FIG. 1, the seventh panel 27 is subdivided into two discontinuous regions 27A by an extension tab 40. The extension tab 40 extends from the eighth panel 28 toward the sixth fold line 36. It will be appreciated that the presence of extension tabs is not necessary, and that the number of extension tabs is not per se critical, and that zero, one or a plurality of extension tabs may be used. The extension tab 40 is formed by cutting through the sheet material along the perimeter of the extension tab 40 and not including a fold line between the extension tab 40 and the remainder of the eighth panel 28. Thus, the seventh fold line 37 is not present between the extension tab 40 and the eighth panel 28. As will be discussed in greater detail below, it is advantageous to remove a small portion of the sheet material so as to provide a space 42 between an edge 44 of the extension tab 40 and the sixth fold line 36.

In the embodiment of the invention shown in FIG. 1, the first panel 21, the second panel 22 and the third panel 23 have the same length L-1. Further, the fourth panel 24, the fifth panel 25, the sixth panel 26, the seventh panel 27, the eighth panel 28, the ninth panel 29 and the tenth panel 30 have the same length L-2. L-1 is preferably greater than L-2 so as to facilitate the insertion of an end cap 46, shown in FIG. 5, into a triangular outer cross-section on each end of the elongate structure 10 when fully assembled.

Figure 2:
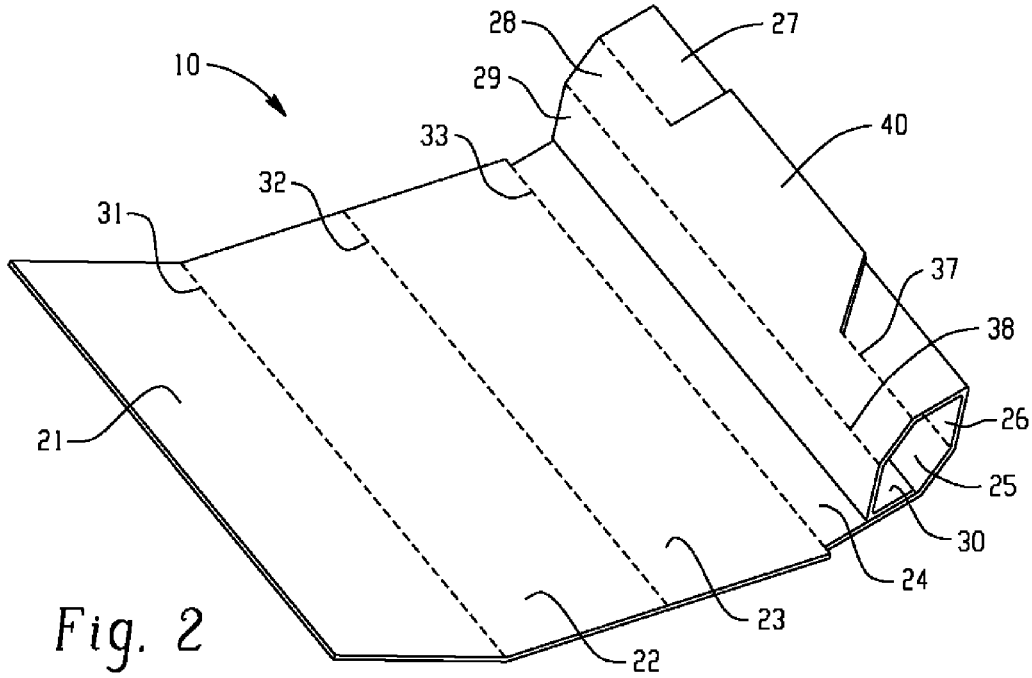
FIG. 2 shows a partially-assembled elongate structure according to the first embodiment of the invention.

FIG. 2 shows the elongate structure 10 in a partially-assembled state according to a first embodiment of the invention. In this configuration, the outer side of the tenth panel 30 has been adhered to the inner side of the fourth panel 24 such that an outside cut edge 30A of the tenth panel 30 is substantially aligned with the fourth fold line 34. This results in the formation of the hollow inner portion 14 having the hexagonal tubular structure whereby the sides of the hollow inner portion 14 are defined by the fifth panel 25, the sixth panel 26, the seventh panel 27, the eighth panel 28, the ninth panel 29 and the tenth panel 30. The elongate structure 10 can conveniently be provided to end-users in this partially-assembled condition.

Figure 3:
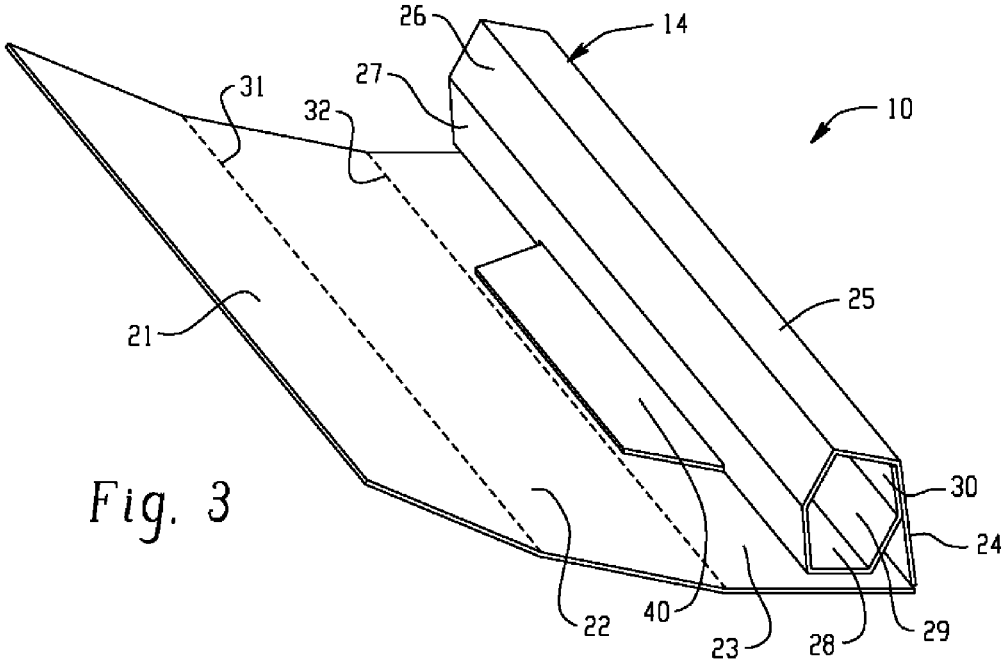
FIG. 3 shows an end perspective view of the elongate structure being assembled from the partially-assembled condition shown in FIG. 2.
Figure 4:
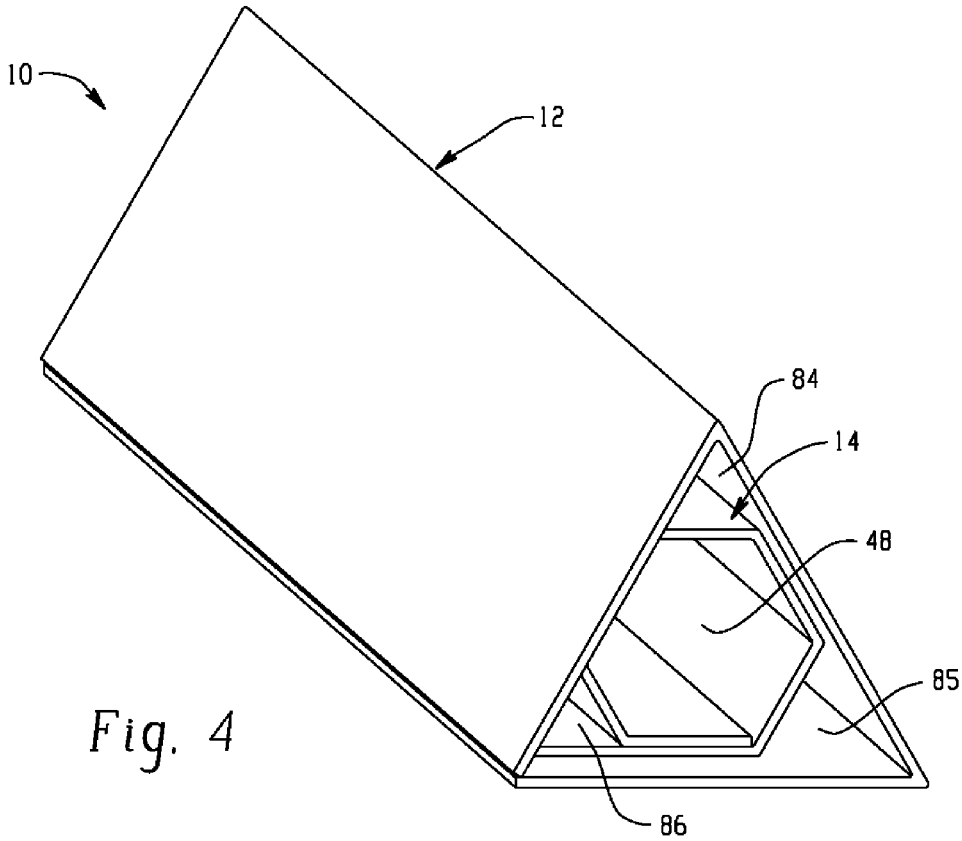
FIG. 4 shows a fully assembled elongate structure according to the first embodiment of the invention.

FIG. 3 shows an end perspective view of the hollow inner portion 14 as the elongate structure 10 is being assembled from the partially-assembled condition shown in FIG. 2. During final assembly, the edge 44 of the extension tab 40 is substantially aligned with the second fold line 32, with the outer side of the eighth panel 28 pressed into contact with the inner side of the third panel 23. Next, the second panel 22 is folded such that the outer side of the sixth panel 26 is pressed into contact with the inner side of the second panel 22. Finally, the outer side of the fourth panel 24 is pressed into contact with the inner side of the first panel 21 to form a fully assembled elongate structure 10, as shown in FIG. 4. Glue, adhesive tape and/or mechanical fasteners can be used to secure the outer side of the fourth panel 24 to the inner side of the first panel 21.

Referring to FIG. 4, as mentioned above, the resulting elongate structure 10 includes the hollow inner portion 14 in the shape of the hexagonal tubular structure disposed within the hollow outer portion 12 in the shape of a triangular tubular structure. The hollow inner portion 14 supports the sidewalls of the hollow outer portion 12, which substantially diminishes the probability of collapse or bending along the longitudinal axis of the elongate structure 10. In addition, a hollow channel 48 having multiple faces is defined by the hollow inner portion 14 and can receive and maintain the integrity of rolled sheet goods and other materials during transit, thereby serving as a shipping container.

Figure 12:
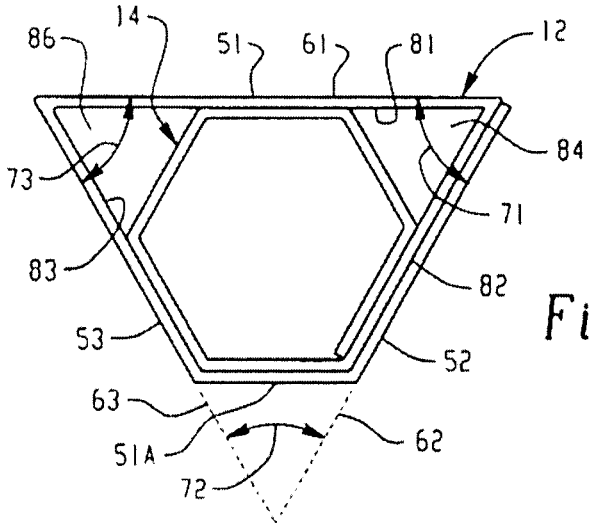
FIG. 12 shows the elongate structure having a trapezoidal shaped cross section according to fifth embodiment of the invention.

Still referring to FIG. 4 and also to FIG. 12, which shows a fifth embodiment described further below, when the elongate structure 10 is fully assembled, the hollow outer portion 12 is defined by a first outer side surface 51 that defines a first plane 61, a second outer side surface 52 that defines a second plane 62 and a third outer side surface 53 that defines a third plane 63 (shown in FIG. 12). The intersection of the first plane 61 and the second plane 62 form a first dihedral angle 71, the intersection of the second plane 62 and the third plane 63 form a second dihedral angle 72, and the intersection of the third plane 63 and the first plane 61 form a third dihedral angle 73. The sum of the first, second, and third dihedral angles 71, 72, 73 is about 180° (shown in FIG. 12).

Still referring to FIGS. 4 and also 12, when the elongate structure 10 is fully assembled the hollow inner portion 14 is in contact with a first inner side 81, a second inner side 82, and a third inner side 83 of the hollow outer portion 12. Further, at least one panel defining the hollow inner portion 14, as explained above, extends between the first and second inner sides 81, 82 to define a hollow triangular channel 84, and between the third and first inner sides 83, 81 to form a hollow triangular channel 86 of the hollow outer portion 12 (see FIGS. 4 and 12). In the embodiment shown in FIG. 4, a panel defining the inner portion 14 also extends between the second and third inner sides 82, 83 to define a hollow triangular channel 85. No such hollow triangular channel (85 in FIG. 4) is present in the embodiment shown in FIG. 12.

Figure 5:
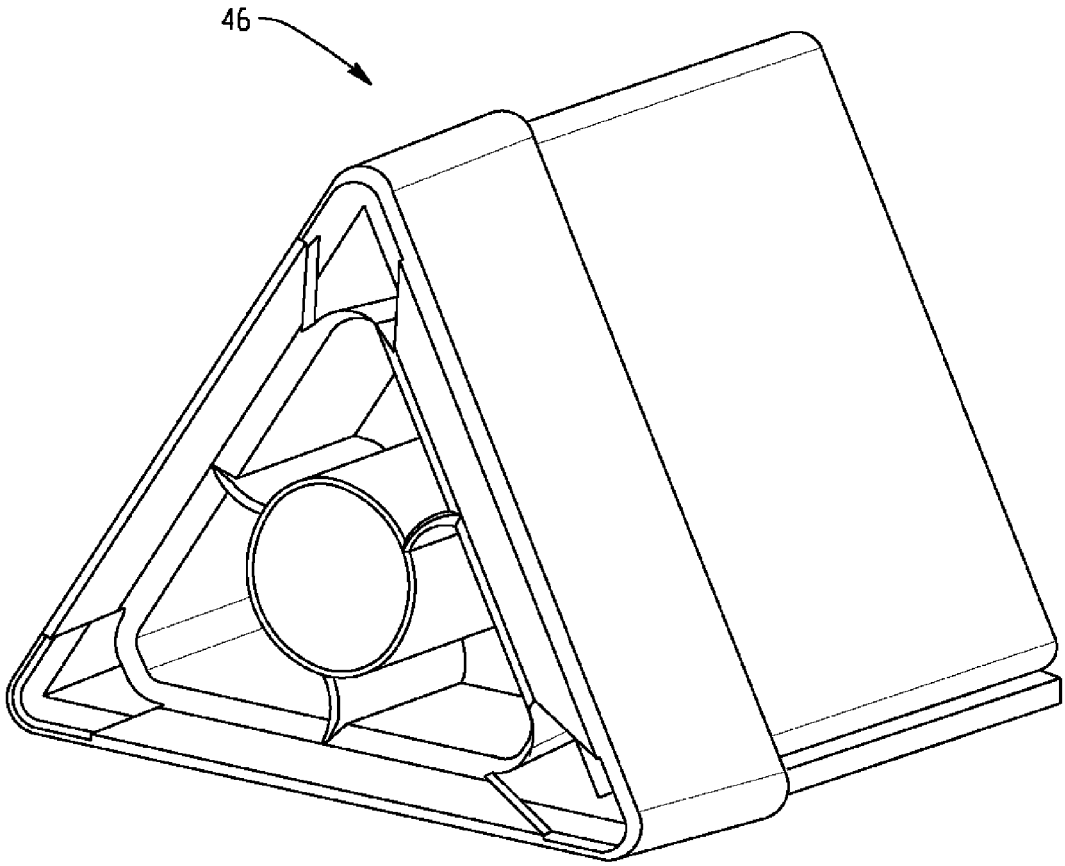
FIG. 5 shows an exemplary end cap applied on an end of the fully assembled elongate structure shown in FIG. 4

Referring to FIG. 5, each end of the elongate structure 10 shown in FIGS. 1-4 is adapted to receive the end cap 46, which can be formed of plastic. It will be appreciated that the end cap 46 can take the same shape as the hollow outer portion 12, such as the triangular shape shown in FIG. 4 or the trapezoidal shape shown in FIG. 12.

Figure 6:
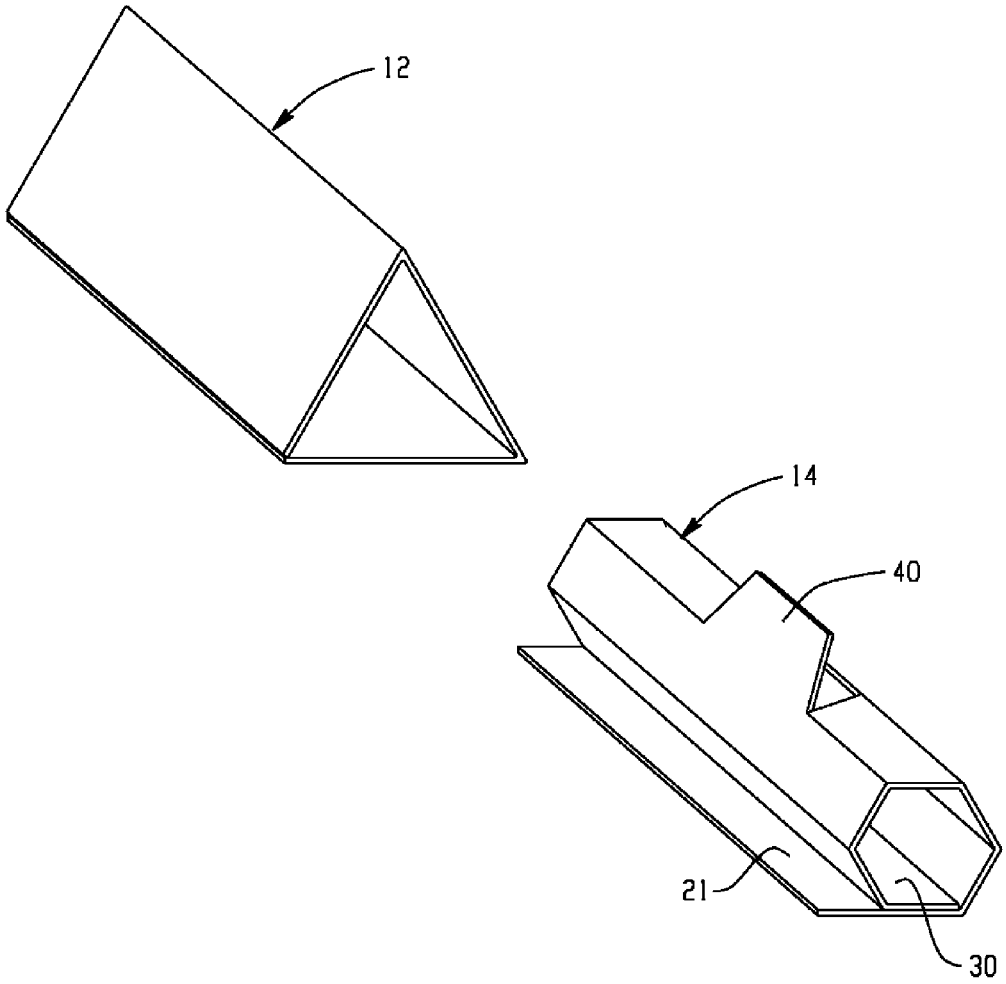
FIG. 6 shows an elongate structure in accordance with a second embodiment of the invention.

It will be appreciated that rather than forming the elongate structure 10 using a single sheet of material, it would also be possible to form the elongate structure 10 via a combination of two portions that would include the hollow outer portion 12 comprised of a generally triangular tubular structure and a separate and distinct hollow inner portion 14 comprised of a polygonal tubular structure. FIG. 6, for example, shows a second embodiment according to the invention that is similar to the first embodiment described above with the exception that the hollow outer portion 12 and the hollow inner portion 14 are made from separate sheets of corrugated cardboard or other sheet material. In the second embodiment of the invention, the hollow inner portion 14 is simply inserted into the hollow outer portion 12 to form the assembled elongate structure 10. Once fully assembled the elongate structure 10 shown in FIG. 6 possesses similar characteristics and features as the elongate structure 10 described in the first embodiment above and shown in FIGS. 1-4.

Figure 7:
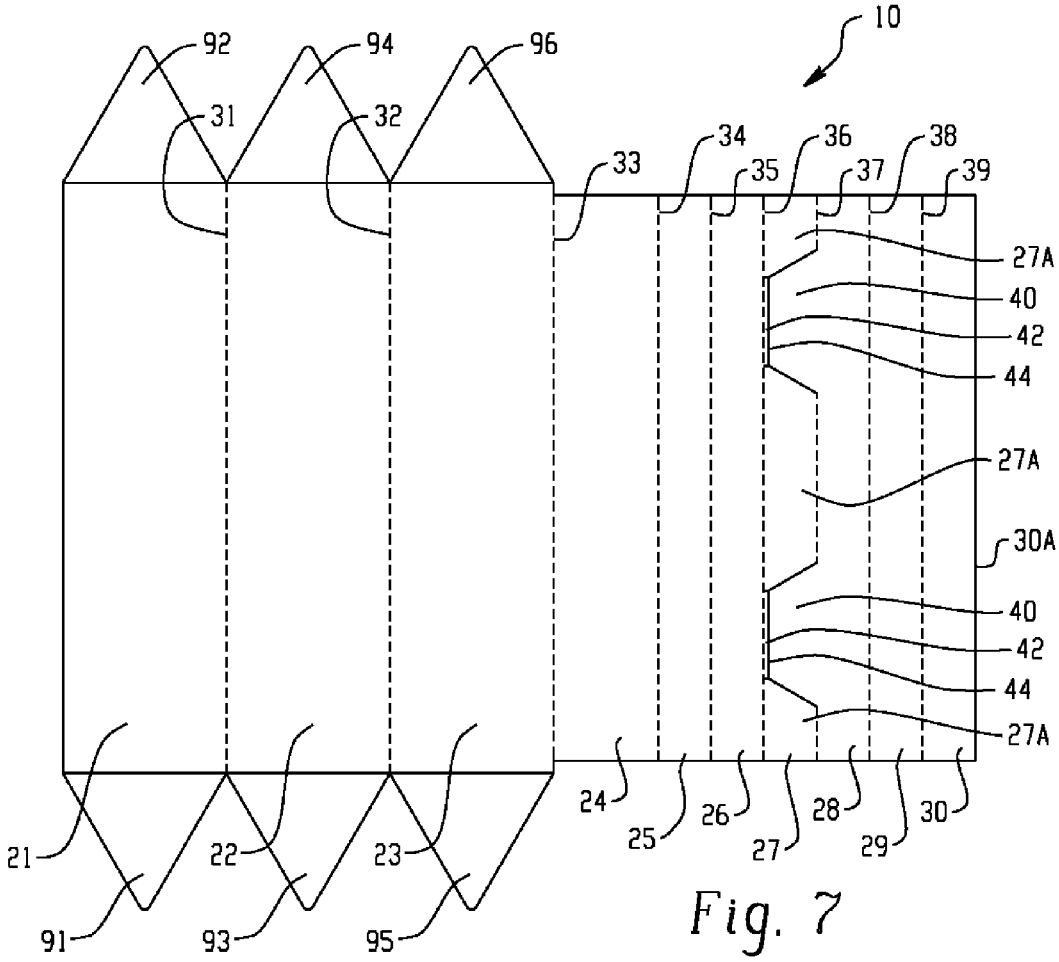
FIG. 7 shows a top view of a completely unassembled elongate structure in accordance with a third embodiment the invention.
Figure 8:
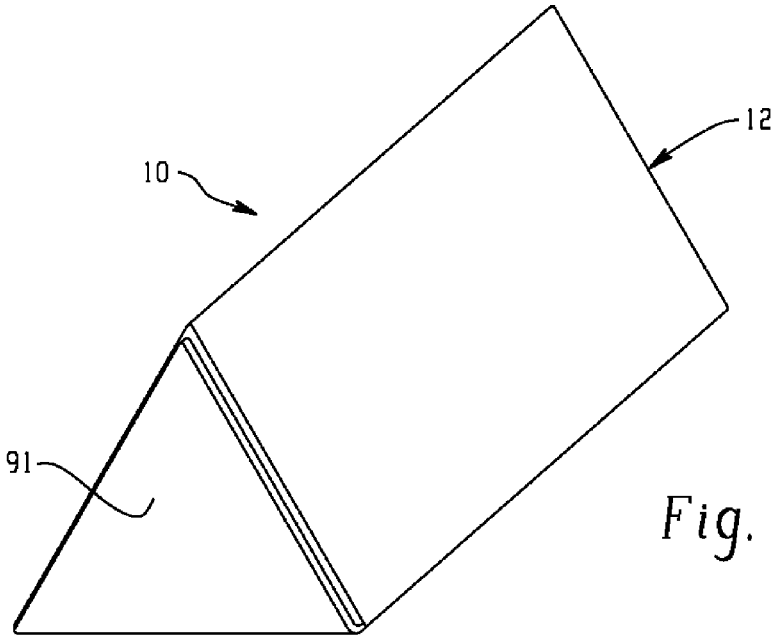
FIG. 8 shows fully assembled elongate structure according to the third embodiment of the invention with end flaps in a closed position.

FIGS. 7 and 8 show a third embodiment of a elongate structure 10 according to the invention. FIG. 7 shows the elongate structure 10 in a completely unassembled state and FIG. 8 shows the elongate structure 10 in a fully assembled state. The same reference numbers used in FIGS. 1-4 to identify portions of the elongate structure 10 are also used in FIGS. 7 and 8 to identify similar portions of the elongate structure 10.

The elongate structure 10 shown in FIGS. 7 and 8 differs from the elongate structure 10 shown in FIGS. 1-4 in the following respects: (1) two extension tabs 40 are used in the elongate structure 10, meaning that the seventh panel 27 is divided into three portions 27A; and (2) triangular end flaps 91, 92, 93, 94, 95, 96 extend from the first panel 21, the second panel 22 and the third panel 23, respectively; and (3) the length of the second panel 22 is greater than the length of the third panel 23, and the length of the first panel 21 is greater than the length of the second panel 22.

Figure 23:
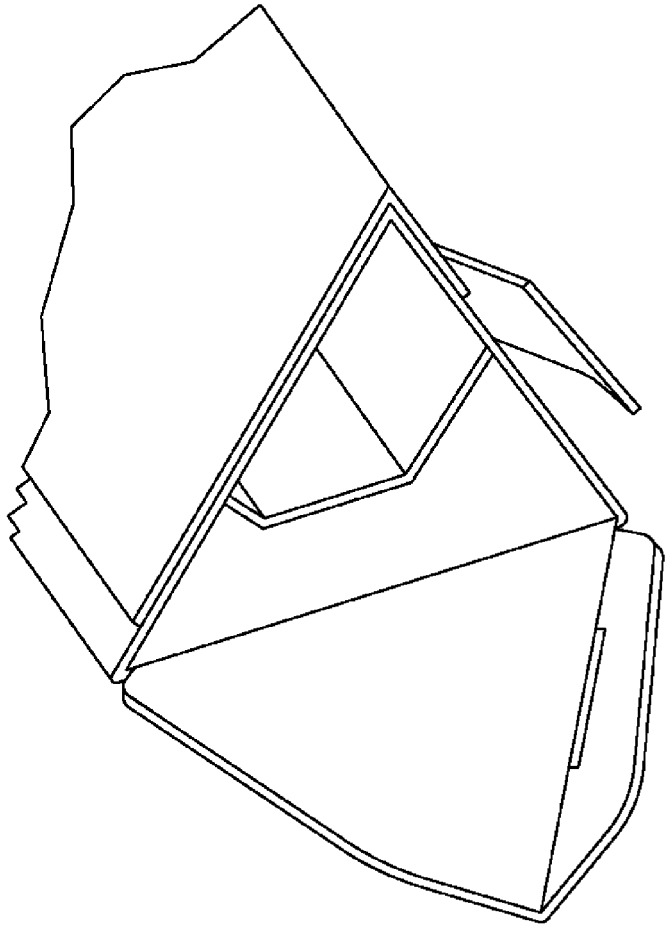
FIG. 23 shows a single end flap closure.

The additional length of the first panel 21 allows triangular end flaps 91, 92 to fold down and cover triangular end flaps 93, 94 respectively, extending from the second panel 22. Further, the additional length of the second panel 22 allows triangular end flaps 93, 94 to fold down and cover triangular end flaps 95, 96 respectively, extending from the third panel 23. Preferably, the length of the fourth panel 24, the fifth panel 25, the sixth panel 26, the seventh panel 27, the eighth panel 28, the ninth panel 29 and the tenth panel 30 are the same, but are less than the length of the third panel 23. The difference in length between the successive panels is preferably equal to the thickness of the material used to form the elongate structure 10. It will be appreciated that when in an assembled condition, the hollow inner portion 14 serves to prevent the end flaps 95, 96 from being forced completely into the hollow channel 48 defined by the hollow outer portion 12. Because the end flaps 95, 96 are supported, subsequent end flaps 93, 94 and 91, 92 overlap to form a three-ply end cap, which can be easily secured through the use of glue, tape or other means. It will be appreciated that the end flaps could be adapted to be secured by other means, such as tabs and slots and that the number of end flaps could be varied from one to three. FIG. 23, for example, shows a single end flap closure. The single flap includes a wing, which tucks into the hollow outer portion and includes a slot, which receives a tab that extends from the hollow outer portion. It will be appreciated that two wings and, optionally, two slots could also be used.

FIG. 8 shows the elongate structure 10 of the third embodiment in a fully assembled state. To close the end flaps, end flap 95 is folded over first, then end flap 93 is folded over onto end flap 95, and finally, end flap 91 is folded over onto end flap 93. Similarly, on the opposite side of the elongate structure 10, end flap 96 is folded over first, then end flap 94 is folded over onto end flap 96, and finally, end flap 92 is folded over onto end flap 94. The end flaps are then secured using adhesive, tape or fasteners.

Figure 9:
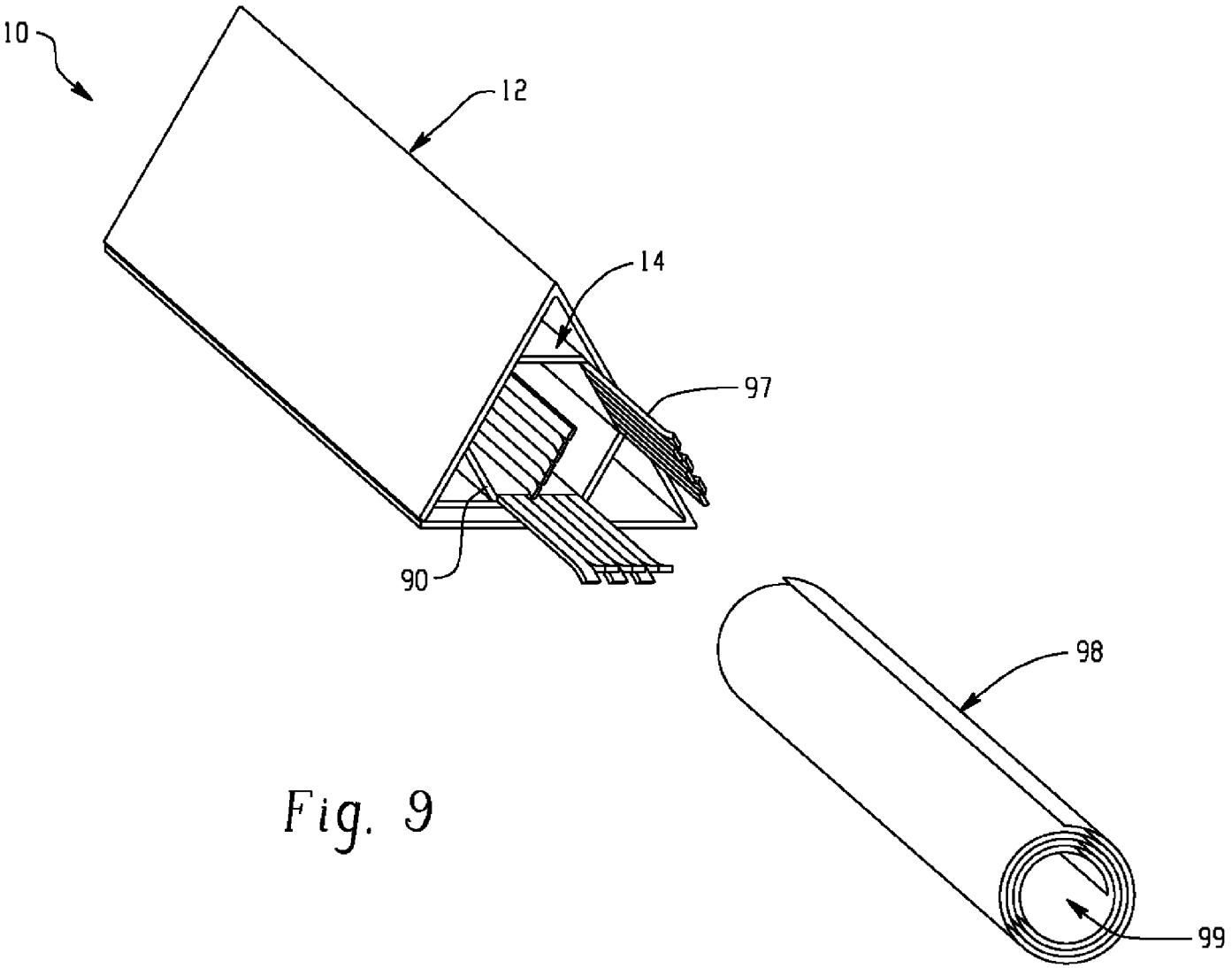
FIG. 9 shows an elongate structure according to a fourth embodiment of the invention.
Figure 10:
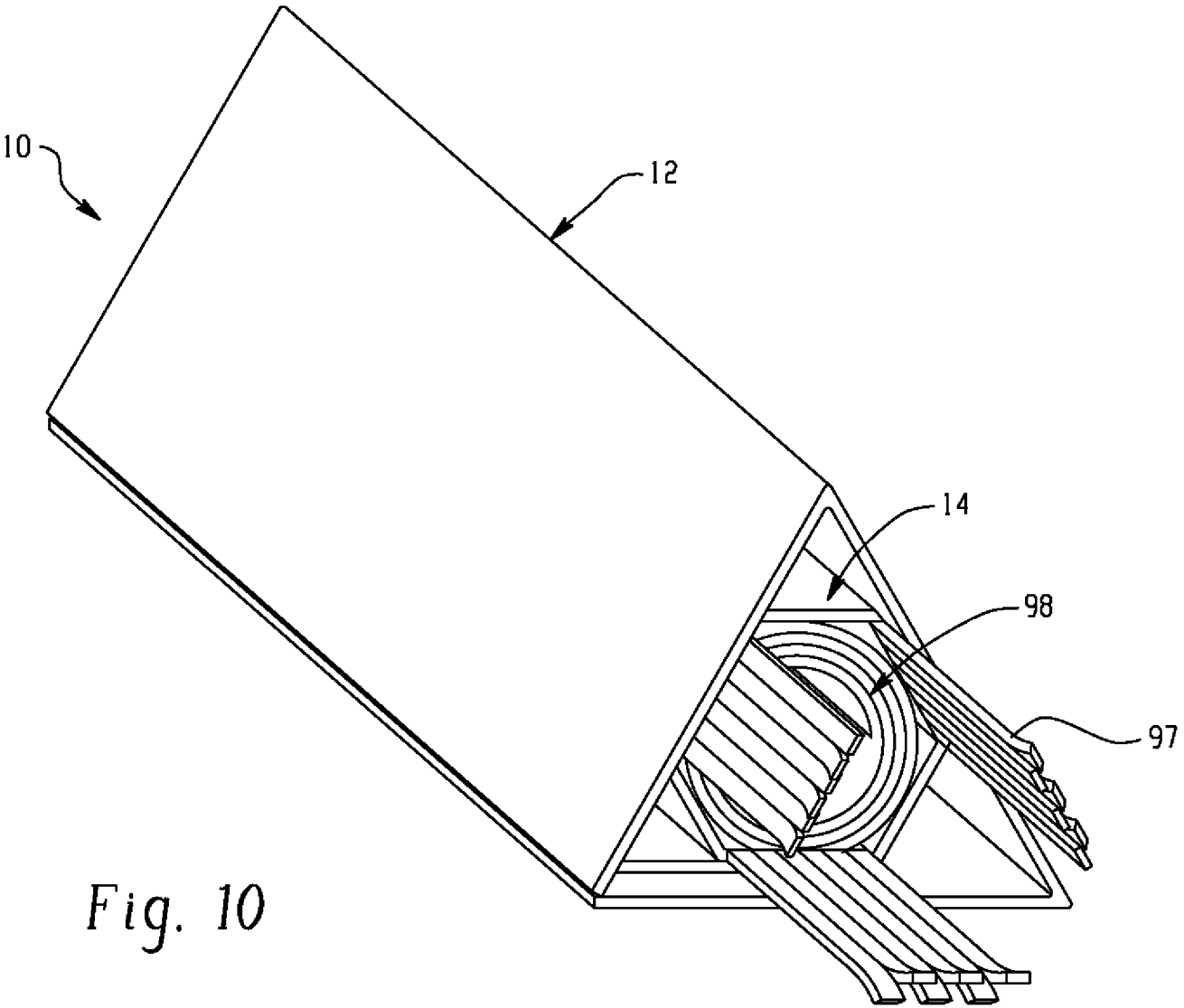
FIG. 10 shows the elongate structure shown in FIG. 9 with rolled sheet matter disposed therein.
Figure 11:
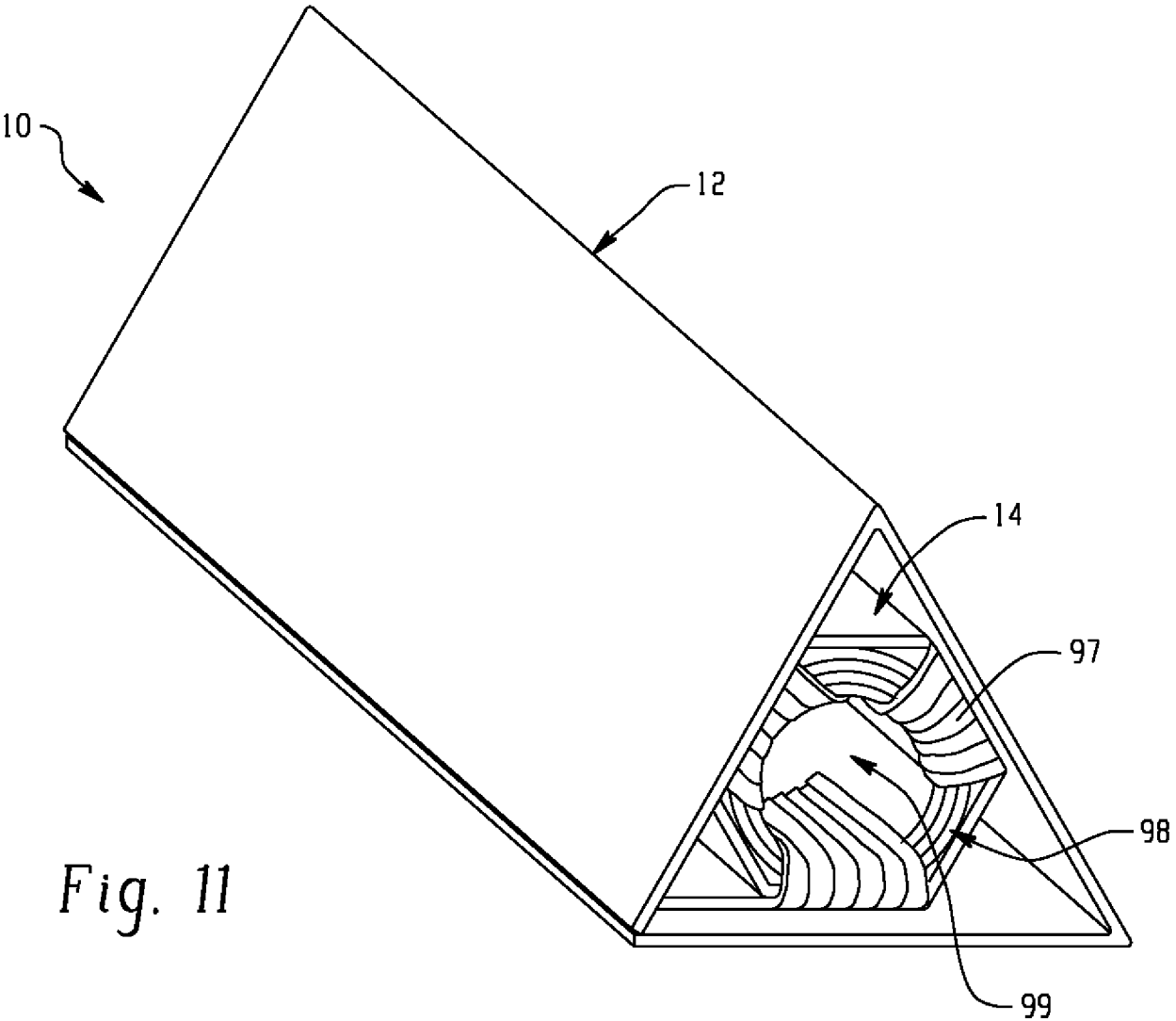
FIG. 11 shows the elongate structure shown in FIG. 9 with the rolled sheet matter secured in the container with thin finger strips.

FIGS. 9-11 show a fourth embodiment of the elongate structure 10. The fourth embodiment is similar to the first embodiment described above with the exception that the fourth embodiment further comprises a plurality of thin finger strips that are adapted to secure rolled sheet matter inside the elongate structure 10. The thin finger strips 97 are attached to a cut edge 90 of one or more designated panels 24-30 that define the hollow inner portion 14. The thin finger strips 97 are movable from an extended position, as shown in FIG. 9, to a securing position, as shown in FIG. 11. Specifically, referring to FIGS. 9 and 10, the thin finger strips 97 are in an extended position to facilitate the insertion of rolled sheet matter 98 into the hollow channel 48 of the hollow inner portion 14. Once the rolled sheet matter is inside the hollow channel 48, the thin finger strips 97 are tucked into a cavity 99 defined by the rolled sheet matter thereby securing the rolled sheet matter inside the elongate structure 10, as shown in FIG. 11.

The embodiment shown in FIGS. 9-11 includes three sets of thin finger strips 97. It will be appreciated that the number of sets of thin finger strips is not per se critical, and that any number of sets of thin finger strips could be used. It will further be appreciated that the thin finger strips may be attached to the cut edge on one or both ends of the designated panels that define the hollow inner portion. The thin finger strips 97 prevent material 98 retained within the hollow part of the inner portion from striking against the end flaps during transit.

Referring again to FIG. 12, which shows a fifth embodiment of the elongate structure 10. The fifth embodiment is similar to the first embodiment described above with the exception that the fifth embodiment has a hollow outer portion 12 that defines the shape of a trapezoid and more specifically, an isosceles trapezoid. An isosceles trapezoid is a trapezoid where the two non-parallel sides and base angles are equal. The hollow outer portion 12 includes a large parallel outer side 51, described in the first embodiment above, and a small parallel side 51A. The hollow inner portion 14 is similar to the hollow inner portion described in the first embodiment. As noted eleven paragraphs above, the hollow outer portion 12 is defined by a first outer side surface 51 that defines a first plane 61, a second outer side surface 52 that defines a second plane 62 and a third outer side surface 53 that defines a third plane 63. The intersection of the first plane 61 and the second plane 62 form a first dihedral angle 71, the intersection of the second plane 62 and the third plane 63 form a second dihedral angle 72, and the intersection of the third plane 63 and the first plane 61 form a third dihedral angle 73. The sum of the first, second, and third dihedral angles 71, 72, 73 is about 180°. The second plane 62 and the third plane 63 intersect along a line that is parallel to, but spaced away from the small parallel side 51A. Thus, while the hollow outer portion 12 defines a trapezoid in cross-section, there are three sides that define planes that intersect to define a generally triangular shape in cross section.

Figure 13:
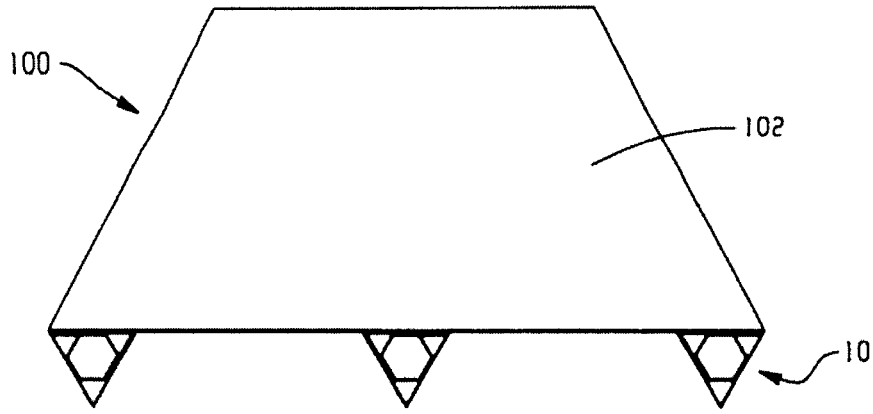
FIG. 13 shows a pallet incorporating the elongate structure according to a first embodiment of the invention.
Figure 14:
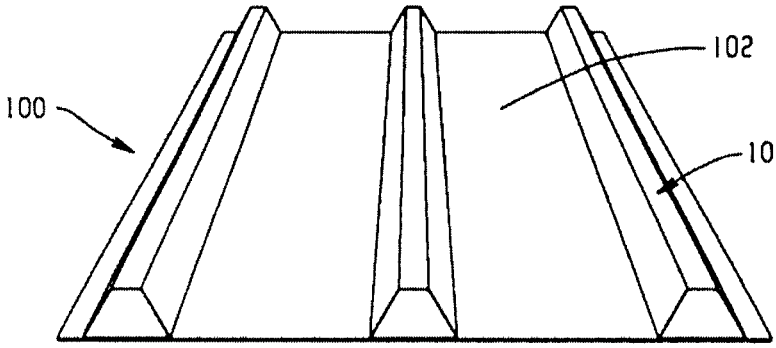
FIG. 14 shows a pallet in an inverted orientation incorporating the fifth embodiment of the invention.
Figure 15:
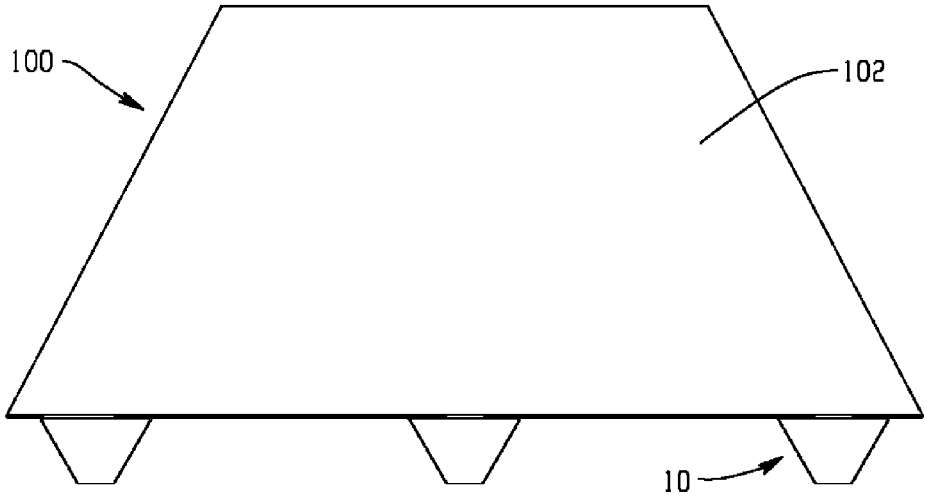
FIG. 15 shows the pallet shown in FIG. 14 in an upright orientation.

Further, the elongate structure 10 of the fifth embodiment possesses similar characteristics and features as the elongate structure 10 described in the first embodiment above and shown in FIGS. 1-4. In addition, because the small parallel side 51A is parallel to the large parallel outer side 51, the elongate structure according to the fifth embodiment of the invention can be used in applications other than shipping containers. For example, FIGS. 13-15 show another application for the elongate structure 10 disclosed herein. Specifically, FIGS. 13-16 illustrate several embodiments of a pallet incorporating the elongate structure 10, which serve as pallet runners for the pallet.

FIG. 13 shows an embodiment of a pallet 100 incorporating the elongate structure 10 according to the first embodiment of the invention. The pallet 100 is formed by securing at least two, and preferably three or more, elongate structures 10 to a sheet 102 of material such as corrugated cardboard. Thus, the elongate structures 10 serve as pallet runners for the pallet 100. The elongate structures 10 can be secured to the sheet 102 using adhesives and/or mechanical fasteners such as staples. The elongate structures 10 support the sheet 102 to which they are fastened above the surface that supports the elongate structures 10. The space between the bottom surface of the sheet 102 and the surface on which the elongate structures 10 rest is sufficient to permit the passage of forks of a forklift or other conventional pallet moving device. The sheet 102 is adapted to support one or more goods in the same manner as conventional wooden pallets.

It will be appreciated that the number and spacing of elongate structures 10, as well as the area of the sheet 102 to which they are secured, can be modified and adjusted for specific applications. A greater number of elongate structures 10 can be used for constructing pallets that are intended to support heavier loads. Furthermore, the number and thickness of the materials used to form the elongate structures 10 and sheets 102 can be varied and customized for the particular application. A two-way pallet is shown in the illustrated embodiment. A two-way pallet includes gaps on the front and rear for the forks of a lift truck, tow motor or pallet jack. It will be appreciated that several shorter elongate structures 10 can be aligned in a spaced apart manner to form a four-way pallet. A four-way pallet also includes gaps on both sides of the pallet for the forks of a lift truck, tow motor or pallet jack.

FIGS. 14 and 15 show another embodiment of the pallet 100 incorporating the fifth embodiment of the invention. FIG. 14 shows the pallet 100 in an inverted position that includes three elongate structures 10 according to the invention. FIG. 15 shows the pallet 100 in an upright position. As mentioned above, the hollow outer portion 12 of the elongate structures 10 defines a trapezoidal cross-section. In this embodiment, integrated end flaps 91-96 described above are used to close each end of the elongate structures 10. In the embodiment shown in FIGS. 14 and 15, the large parallel side 51 of the two parallel sides of the elongate structure 10 is secured to a bottom surface of the sheet material 102. Thus, the small parallel side 51A is in contact with the surface that the elongate structure 10 rests on, thereby leaving a space between the resting surface and the bottom surface of the sheet 102 to facilitate pallet moving equipment to pass.

Figure 16:
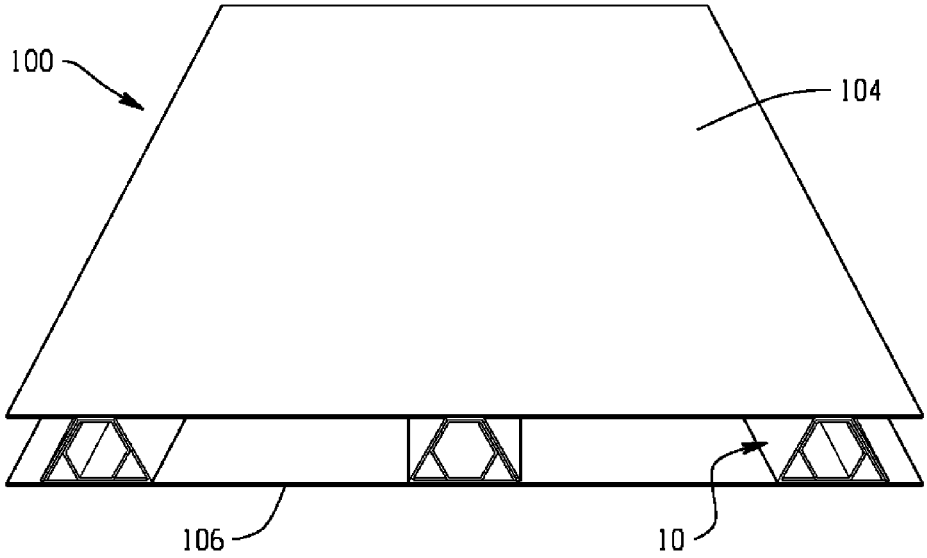
FIG. 16 shows another embodiment of the pallet incorporating the fifth embodiment of the invention.

FIG. 16 shows yet another embodiment of the pallet 100 incorporating the fifth embodiment of the invention. This embodiment is similar the embodiment shown in FIGS. 14 and 15 with the exception that this embodiment includes two sheets of material. Specifically, multiple elongate structures 10 are positioned between a top sheet 104 and a bottom sheet 106 of material to thereby form the pallet 100. Again the hollow outer portion 12 of the elongate structures 10 defines a trapezoidal cross-section. In addition, in this embodiment, each end of the elongate structures 10 is open. Thus, It will be appreciated that each end of the elongate structures 10 where the hollow outer portion 12 defines a trapezoid can be open, closed using external end caps 46, as shown in FIG. 5, or closed using the integrated end flaps 91-96 made of the same material as the elongate structures 10.

It will be appreciated that the orientation of the elongate structures 10 can be altered. Specifically, in the embodiment shown in FIG. 16, the small parallel side 51A of each elongate structure 10 is attached to the top sheet 104 and the large parallel side 51 of each elongate structure 10 is attached to the bottom sheet 106. In other embodiments, the small parallel side 51A of one or more elongate structures 10 can be attached to the bottom sheet 106 and the large side 51 of one or more elongate structures 10 can be attached to the top sheet 104.

Figure 17:
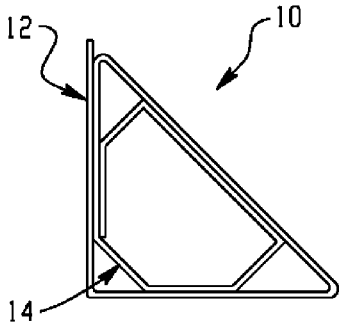
FIG. 17 shows a cross-section of a sixth embodiment of the elongate structure.
Figure 18:
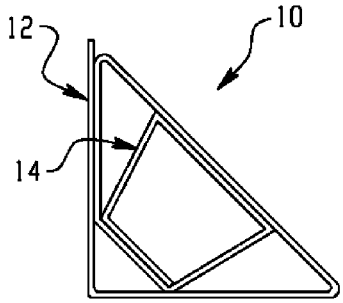
FIG. 18 shows a cross-section of a seventh embodiment of the elongate structure.
Figure 19:
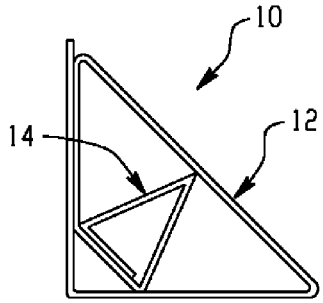
FIG. 19 shows a cross-section of an eighth embodiment of the elongate structure.

FIGS. 17-19 show a sixth, seventh, and eighth embodiment, respectively, of the elongate structure 10. In these embodiments, the hollow outer portion 12 has a cross-section that defines a right isosceles triangle that includes a first side, a second side, and a third side. The intersection of the first side and the second side form an angle that is about 90°. Further, the intersection of the second side and the third side form an angle that is about 45°. Similarly, the intersection of the third side and the first side form an angle that is about 45°. Thus, the sum of the three angles is about 180°.

Still referring to FIGS. 17-19, the hollow inner portion 14 is a polygonal shape that may include n panels or sides, where n is 3, 4, 5 or 6. For example, the hollow inner portion 14 in the embodiment shown in FIG. 17 has six sides thereby forming a hexagonal tubular structure. Further, the hollow inner portion 14 in the embodiment shown in FIG. 18 has four sides and the hollow inner portion 14 in the embodiment shown in FIG. 17 has three sides. In regards to the embodiment shown in FIG. 17, it will be appreciated that the hexagonal tubular structure need not have sides of equal length. For example, the sides of the hexagonal tubular structure that contact the sides of the triangular tubular structure could be larger than the sides of the hexagonal tubular structure that span across the corners of the triangular tubular structure, as shown in FIG. 17. The elongate structure 10 shown in FIGS. 17-19 has similar characteristics and features to the elongate structure 10 described above in the first embodiment.

Figure 20:
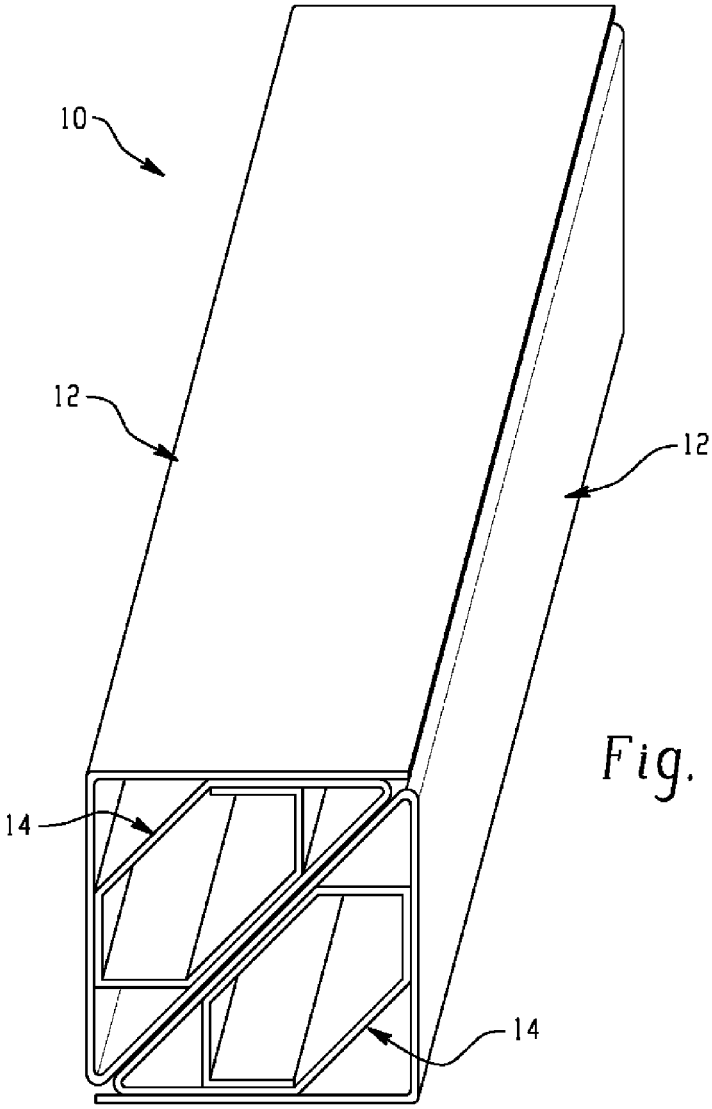
FIG. 20 shows the elongate structure having an outer surface that defines a square shape.

FIG. 20 shows two elongate structures 10 shown in FIG. 17 joined together to form an elongate structure having a square cross section. The outer faces of the third side of each elongate structure 10 are joined together (e.g., using a mechanical fastener or an adhesive) to form the substantially square cross section. The structure shown in FIG. 20 can be used as a pallet runner as described above may be used in other applications such a corner post for a shipping container, as will be described below, or for light construction (e.g., for product displays).

Figure 21:
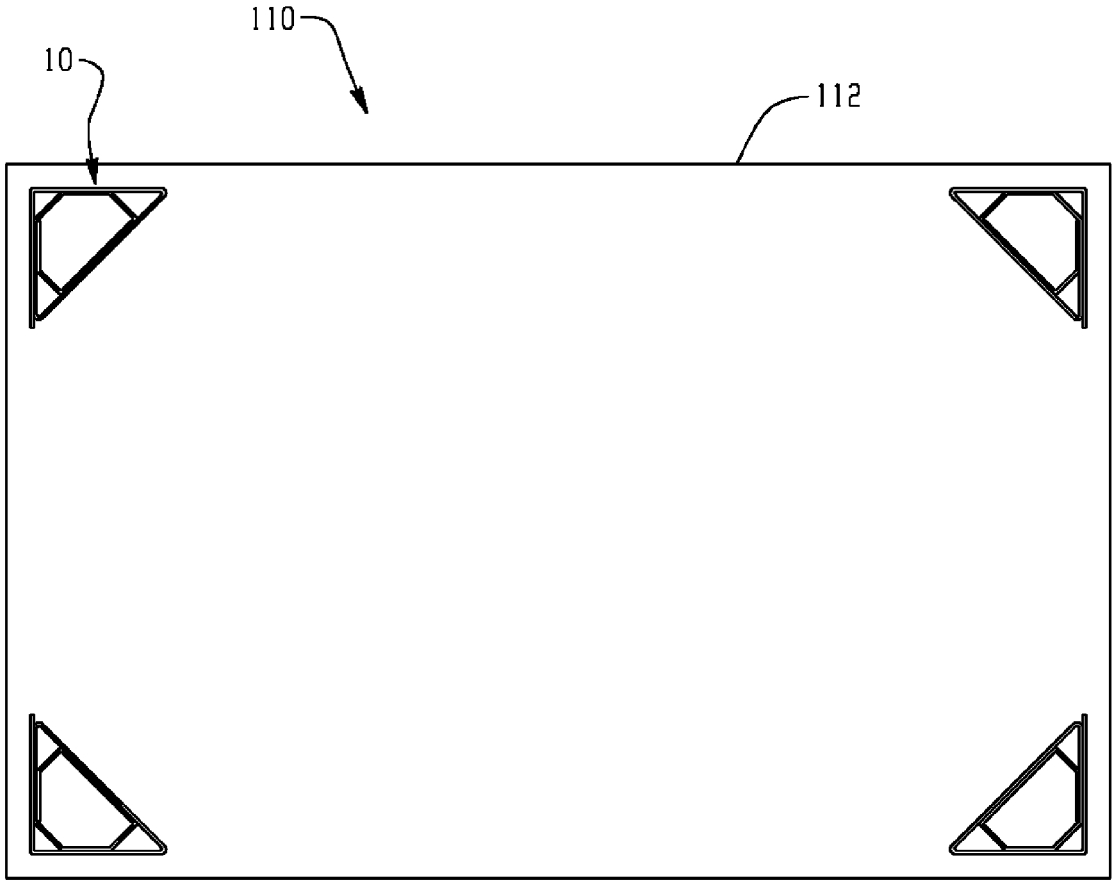
FIG. 21 shows shipping container incorporating the elongate structure according to the sixth embodiment of the invention.

FIG. 21 shows yet another application for the elongate structure 10 disclosed herein. Specifically, FIG. 21 shows a schematic top plan view of a large shipping container 110 (e.g., a container often referred to in the art as a "Gaylord" container) incorporating the elongate structure 10 according to the sixth embodiment of the invention. The shipping container 110 includes four walls 112 and four elongate structures 10 that serve as corner posts for the container. The first and second sides of each elongate structure 10 can be disposed in and optionally attached to two walls 112 at each corner of the container 110. The elongate structures 10 provide stability to the container for heavy load applications. It will be appreciated that the embodiments shown in FIGS. 18-20 can be incorporated into the container 110 shown in FIG. 21.

It will be appreciated that the elongate structure disclosed herein may take on several properties and alternative configurations. For example, the elongate structure can be formed from sheet materials such as corrugated paper, solid core fiberboard material, plastic corrugated sheeting and other materials. The panels of the elongate structure can be single walled, double walled or greater, if desired. The materials from which the elongate structure is constructed can be waterproof, water-resistant and/or can be treated to provide water resistance, if desired. The sheet material (also known as the deck) for the pallets disclosed herein can be made of the same material as the elongate structure or can be made of a different material. Furthermore, composites of two or more different materials can be used. In addition, and as shown in FIG. 23, trapezoidal pallet runners can be received into decks that feature a "dove-tail" slot therefore. It will be appreciated that triangular pallet runners can also be secured to decks in this manner.

It will be appreciated that the elongate structure and the pallets according to the invention provide many advantages and benefits over the prior art. For example, pre-cut and pre-creased sheets for use in constructing the elongate structure according to the invention can be shipped to end users and stored by end users in a compact, stacked arrangement until the time of use. At that time, the end user can construct as many elongate structures as are presently needed.

Figure 22A:
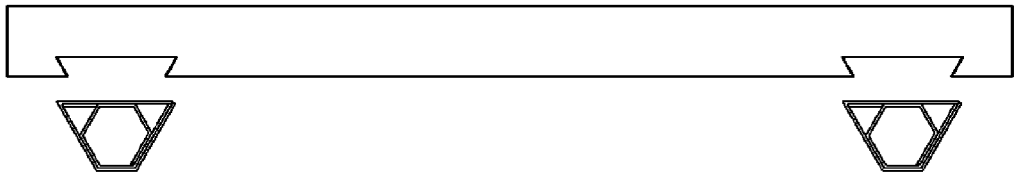
FIGS. 22A and 22B show trapezoidal pallet runners being received into decks that feature a "dove-tail" slot for the pallet runners.
Figure 22B:
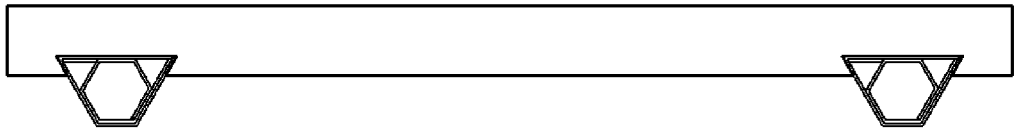

Elongate structures according to the invention are lightweight, yet very strong. Further, the triangular or trapezoidal cross-sectional hollow outer portion lends well to the creation of custom pallet designs without the need to maintain a large inventory of different elongate structures. Jigs can be created by end users to suit the end user's particular needs for specific shipping needs. In addition, pallets having different configurations can be made on-site by end users using the same materials quickly and at relatively low cost. Furthermore, the pallets cut down on used pallet storage and warehouse hygiene issues. FIGS. 22A and 22B shows trapezoidal pallet runners being received into decks that feature a "dove-tail" slot for the pallet runners.

Pallets according to the invention can be made from 100% recycled materials. Furthermore, the pallets themselves can also be recycled. Preferably, the pallets according to the invention do not include nails or other metallic fasteners, which can cause injury hazards to employees.

Pallets according to the invention are particularly suitable for use in shipping low density products, such as potato chips and other snacks. But due to their substantial strength to weight ratio, they can be used to support many goods that heretofore have been shipped on traditional wooden pallets.

Because the elongate structure disclosed herein is exceptionally strong the elongate structure can have many applications. For example, as mentioned above, the elongate structure can be used as a shipping container to ship rolled sheet matter. Further, the elongate structure can be used as a pallet runner or as a corner post for large shipping containers Additional advantages and modifications will readily occur to those skilled in the art. Therefore, the invention in its broader aspects is not limited to the specific details and illustrative examples shown and described herein. Accordingly, various modifications may be made without departing from the spirit or scope of the general inventive concept as defined by the appended claims and their equivalents.

What is claimed is:

1. An elongate structure comprising:

a hollow outer portion formed of sheet material; and a hollow inner portion formed of sheet material;

wherein the hollow outer portion and the hollow inner portion are integrally formed from a single piece of sheet material, wherein the hollow outer portion includes at least a first outer side surface that defines a first plane, a second outer side surface that defines a second plane, and a third outer side surface that defines a third plane, wherein the first plane intersects with the second plane at a first dihedral angle, the second plane intersects with the third plane at a second dihedral angle, and third plane intersects with the first plane at a third dihedral angle, wherein the sum of the first dihedral angle, the second dihedral angle and the third dihedral angle is about 180°, wherein the hollow inner portion is disposed within the hollow outer portion, wherein the hollow inner portion comprises a plurality of elongate panels that cooperate to define an inner hexagonal channel, wherein the hollow inner portion contacts a first inner side of the hollow outer portion opposite the first outer side surface, a second inner side of the hollow outer portion opposite the second outer side surface, and a third inner side of the hollow outer portion opposite the third outer side surface, and wherein one of the plurality of elongate panels of the hollow inner portion extends between the first inner side of the hollow outer portion and the second inner side of the hollow outer portion so as to define a first hollow inner triangular channel, and another one of the plurality of elongate panels of the hollow inner portion extends between the second inner side of the hollow outer portion and the third inner side of the hollow outer portion so as to define a second hollow inner triangular channel.

2. The elongate structure according to claim 1, wherein a yet another one of the plurality of elongate panels of the hollow inner portion extends between the third inner side of the hollow outer portion and the first inner side of the hollow outer portion so as to define a third hollow inner triangular channel.

3. The elongate structure according to claim 1, wherein the elongate structure includes a first end, and wherein an end cap is secured to the elongate structure at the first end.

4. The elongate structure according to claim 1, wherein the elongate structure includes a first end, and wherein the first end is closed off by a plurality of overlapping folded flaps that extend from the hollow outer portion.

5. The elongate structure according to claim 1, wherein the first dihedral angle is about 60°, the second dihedral angle is about 60° and the third dihedral angle is about 60°.

6. The elongate structure according to claim 1, wherein two of the first dihedral angle, the second dihedral angle and the third dihedral angle are about 45°.

7. The elongate structure according to claim 1, wherein the single piece of sheet material comprises a plurality of plies.

8. The elongate structure according to claim 1, wherein the single piece of sheet material comprises paperboard.

9. The elongate structure according to claim 1, wherein at least one strip of adhesive bonds overlapping plies of the hollow outer portion together.

10. A pallet comprising:

a deck having a top side and a bottom side; and a plurality of pallet runners secured to the bottom side of the deck;

wherein at least one of the plurality of pallet runners is an elongate structure according to claim 1.

11. The pallet according to claim 10, wherein the deck and the plurality of pallet runners are formed of paperboard.

12. A substantially flat piece of sheet material provided with a plurality of creases that define fold lines, wherein when the substantially flat piece of sheet material is folded on the plurality of creases an elongate structure according to claim 1 is formed.

13. The substantially flat piece of sheet material according to claim 12, wherein at least one strip of adhesive bonds together overlapping plies that, when substantially flat piece of sheet material is folded, form the hollow inner portion.

14. A method of forming an elongate structure comprising:

providing a substantially flat piece of sheet material according to claim 12; and folding the substantially flat piece of sheet material along the fold lines to form the elongate structure.

15. The method according to claim 14, wherein the elongate structure includes a first end, and wherein a plurality of flaps extend from the hollow outer portion, and wherein the method further comprises closing off the first end by folding the plurality of flaps in an overlapping manner.

16. An elongate structure comprising:

a hollow outer portion formed of sheet material; and a hollow inner portion formed of sheet material;

wherein the hollow outer portion and the hollow inner portion are each formed from separate, single pieces of sheet material, wherein the hollow outer portion includes at least a first outer side surface that defines a first plane, a second outer side surface that defines a second plane, and a third outer side surface that defines a third plane, wherein the first plane intersects with the second plane at a first dihedral angle, the second plane intersects with the third plane at a second dihedral angle, and third plane intersects with the first plane at a third dihedral angle, wherein the sum of the first dihedral angle, the second dihedral angle and the third dihedral angle is about 180°, wherein the hollow inner portion is disposed within the hollow outer portion, wherein the hollow inner portion comprises a plurality of elongate panels that cooperate so as to define an inner hexagonal channel, wherein the hollow inner portion contacts a first inner side of the hollow outer portion opposite the first outer side surface, a second inner side of the hollow outer portion opposite the second outer side surface, and a third inner side of the hollow outer portion opposite the third outer side surface, and wherein one of the plurality of elongate panels of the hollow inner portion extends between the first inner side of the hollow outer portion and the second inner side of the hollow outer portion so as to define a first hollow inner triangular channel, and another one of the plurality of elongate panels of the hollow inner portion extends between the second inner side of the hollow outer portion and the third inner side of the hollow outer portion so as to define a second hollow inner triangular channel.

17. The elongate structure according to claim 16 wherein the separate, single pieces of sheet material used to form both the hollow outer portion and the hollow inner portion comprise paperboard.

* * * * *